US011624186B2

(12) United States Patent
Sessler

(10) Patent No.: US 11,624,186 B2
(45) Date of Patent: Apr. 11, 2023

(54) UNITARY DOUBLE STUD ASSEMBLY FOR SOUND DAMPING WALL

(71) Applicant: Jon Sessler, Sumner, WA (US)

(72) Inventor: Jon Sessler, Sumner, WA (US)

( * ) Notice: Subject to any disclaimer, the term of this patent is extended or adjusted under 35 U.S.C. 154(b) by 0 days.

(21) Appl. No.: 17/411,826

(22) Filed: Aug. 25, 2021

(65) Prior Publication Data

US 2022/0074199 A1 Mar. 10, 2022

Related U.S. Application Data

(60) Provisional application No. 63/076,241, filed on Sep. 9, 2020.

(51) Int. Cl.

| | |
|---|---|
| ***E04B 2/60*** | (2006.01) |
| ***E04C 3/32*** | (2006.01) |
| ***E04B 2/74*** | (2006.01) |
| ***E04B 2/78*** | (2006.01) |

(52) U.S. Cl.

CPC ..... *E04B 2/60* (2013.01); *E04B 2/7409* (2013.01); *E04B 2/7412* (2013.01); *E04B 2/7414* (2013.01); *E04B 2/7457* (2013.01); *E04B 2/789* (2013.01); *E04B 2/7854* (2013.01); *E04C 3/32* (2013.01)

(58) Field of Classification Search

CPC ..... E04B 2/60; E04B 2/7409; E04B 2/7412; E04B 2/7414; E04B 2/7457; E04B 2/7854; E04B 2/789; E04C 3/32

See application file for complete search history.

(56) References Cited

U.S. PATENT DOCUMENTS 1,951,346 A * 3/1934 Collins ..... E04B 9/22 52/363
2,363,164 A * 11/1944 Waller ..... E04B 2/7854 52/772

(Continued)

FOREIGN PATENT DOCUMENTS

| | | | | |
|---|---|---|---|---|
| CN | 108678233 A | * | 10/2018 | ..... E04B 1/7608 |
| DE | 202012012342 U1 | * | 5/2013 | ..... E04B 2/7422 |
| EP | 2 691 585 A | | 2/2014 | |

OTHER PUBLICATIONS

"A Practical Guide to Office Acoustics," Version 1.0, Robert Derector Associates / SIA Acoustics, Jul. 24, 2020, 56 pages.

(Continued)

*Primary Examiner* — Jessie T Fonseca
(74) *Attorney, Agent, or Firm* — Seed IP Law Group LLP

(57) ABSTRACT

A wall assembly includes tracks structured to be coupled to supports and wall studs coupled to the tracks. The wall studs include a first sidewall, a first web coupled to the first sidewall and a second sidewall coupled to the first web to define a first channel. The wall studs further include a second web coupled to the second sidewall and a third sidewall coupled to the second web to define a second channel as well as a third web coupled to the third sidewall and a fourth sidewall coupled to the third web to define a third channel. The second web is offset from the first web and the third web to isolate each of the channels and attenuate sound waves. Further, the studs may include one or more openings for further isolation and to reduce the amount of steel in the studs, which reduces cost.

20 Claims, 16 Drawing Sheets

(56) References Cited

U.S. PATENT DOCUMENTS 2,958,982 A * 11/1960 Baker ..... E04B 2/7854 52/354
3,270,472 A * 9/1966 Gilbert ..... E04B 2/7457 52/364
3,925,948 A 12/1975 Sauer et al.
4,835,935 A * 6/1989 Murphy ..... E04B 1/2403 403/403
5,606,840 A * 3/1997 Hase ..... E04C 2/546 52/307
5,647,186 A * 7/1997 Donaldson ..... E04B 2/60 52/656.1
5,907,932 A 6/1999 LeConte et al.
7,223,043 B1 5/2007 Andrews
7,594,331 B2 9/2009 Andrews et al.
8,061,099 B2 11/2011 Andrews
8,074,416 B2 12/2011 Andrews
8,307,610 B2 11/2012 Landers
9,523,197 B2 * 12/2016 Sessler ..... E04B 2/7457
9,771,715 B2 * 9/2017 Sessler ..... E04B 1/8209
2005/0241258 A1 * 11/2005 Shih ..... E04C 3/09 52/647
2006/0032183 A1 * 2/2006 Peterson ..... E04B 2/7457 52/836
2010/0218451 A1 * 9/2010 Andrews ..... E04B 2/767 52/655.1
2012/0000149 A1 1/2012 Rice
2012/0066993 A1 * 3/2012 Mommer ..... E04B 2/7854 52/309.4
2015/0361659 A1 * 12/2015 Sessler ..... E04B 1/8409 52/483.1
2017/0044760 A1 * 2/2017 Sessler ..... E04B 1/8409

OTHER PUBLICATIONS

"TRAKLOC® Stud Products: Trakloc® Elevator Stud™ (TLE)," ClarkDietrich, Apr. 25, 2018, 1 page.

* cited by examiner

UNITARY DOUBLE STUD ASSEMBLY FOR SOUND DAMPING WALL

BACKGROUND

Technical Field

The present disclosure is directed to a structural support system that provides acoustic damping, and more specifically, to a wall stud and track system that reduces transmission of sound waves through structural components.

Description of the Related Art

It is desirable in many environments to reduce transmission of sound and vibration through walls of adjacent rooms. This is particularly important in high occupancy buildings such as offices, apartments, and other similar environments, although reduction of sound transmission can also be desirable in typical single family homes and similar environments with lower occupancy.

One measure of how well a building partition attenuates airborne sound is called the sound transmission coefficient or sound transmission class (generally referred to herein as "STC"). The STC roughly reflects the decibel reduction of noise through a partition. In general, the higher the STC of a partition, the better that partition attenuates sound. Generally, an STC in the range of 35 or lower indicates that the wall provides little attenuation of acoustic waves and a significant amount of sound will pass from one room to another through the wall, while an STC in the range of 55-60 or more will provide substantial reduction in sound transmitted through a wall and is therefore often desired. A typical interior wall with a single layer of drywall or gypsum board on each side, a single row of metal studs, and insulation at least in the stud cavities may have an STC of approximately 35-40. Adding a second row of metal studs, such as in a double stud assembly, with one layer of gypsum wall board on each side and insulation in the stud cavities may increase the STC to approximately 52-55.

While construction processes that utilize two rows of studs can achieve high STC ratings, such methods and products also use significantly more steel because there are twice as many studs, which increases costs. Further, the extra row of studs increases labor hours and labor costs to install additional materials, which can affect the project schedule and budget. Other past attempts to increase the STC of wall assemblies have focused on specialty products which, in many instances, are prohibitively expensive. Yet further techniques have been to add additional layers of conventional materials that increase the mass, which, while increasing the STC rating, adds significant cost as well as additional labor cost to install. Another downside of using multiple layers of materials is the reduction in floor area as a result of the additional layers of material extending further into a room than single layers of material.

BRIEF SUMMARY

The present disclosure is directed to a wall assembly that attenuates sound and vibration. The wall assembly includes tracks that are configured to be coupled to supports, such as floor joists or ceiling beams, or concrete in some examples. Wall studs are coupled to the tracks and extend vertically between the tracks to provide support for the wall assembly. The wall studs are of a unitary stud design with multiple channels to increase the wall thickness, which improves the attenuation of sound without a second row of studs. Namely, there are two studs joined together in a single structure to form a unitary assembly. Further, the studs include one or more openings to further reduce the amount of steel in each stud, which reduces the cost. The one or more openings also further attenuate sound by isolating the structural components of the stud to reduce transmission of sound through the studs and by reducing resonance of sound in and through the studs. In some non-limiting examples, the tracks may further include one or more openings to provide additional sound attenuation benefits.

More specifically, a wall assembly includes a first track configured to be coupled to a support and including a first channel. A second track is configured to be coupled to a support and includes a second channel. The first and second tracks are aligned with each other and configured to be coupled to opposite vertical sides of the desired location of a wall (such as to the floor and ceiling, respectively). A wall stud has a first end that is received in the first channel of the first track and a second end received in the second channel of the second track, such that the wall stud extends vertically.

The wall stud includes a multiple channel design with a first sidewall, a first web coupled to the first sidewall and a second sidewall coupled to the first web to define a first channel. A second web is coupled to the second sidewall and a third sidewall is coupled to the second web to define a second channel. A third web is coupled to the third sidewall and a fourth sidewall is coupled to the third web to define a third channel. The second web is offset from the first web and the third web to isolate each of the channels from each other. There may be one or more openings in each of the first web, the second web, and a third web. Further, there may be one or more openings in each of the first, second, third, and fourth sidewalls. The stud design and openings attenuate sound and increase the STC of wall partitions while minimizing the amount of steel and thus reducing cost. Further, the single stud design is more efficient to install because there is only row of studs.

BRIEF DESCRIPTION OF THE SEVERAL VIEWS OF THE DRAWINGS

For a better understanding of the embodiments, reference will now be made by way of example only to the accompanying drawings. In the drawings, identical reference numbers identify similar elements or acts. In some figures, the structures are drawn to scale. In other figures, the sizes and relative positions of elements in the drawings are not necessarily drawn to scale. For example, the sizes, shapes of various elements and angles may be enlarged and positioned in the figures to improve drawing legibility.

DETAILED DESCRIPTION

The present disclosure is generally directed to structural support systems that attenuate sound and vibration. While the following description describes non-limiting examples of wall assemblies according to the present disclosure, it is to be appreciated that the concepts presented herein can be applied to any location or structural support where a reduction in sound transmission is desired. As such, the present disclosure is not limited solely to wall assemblies.

Figure 1:
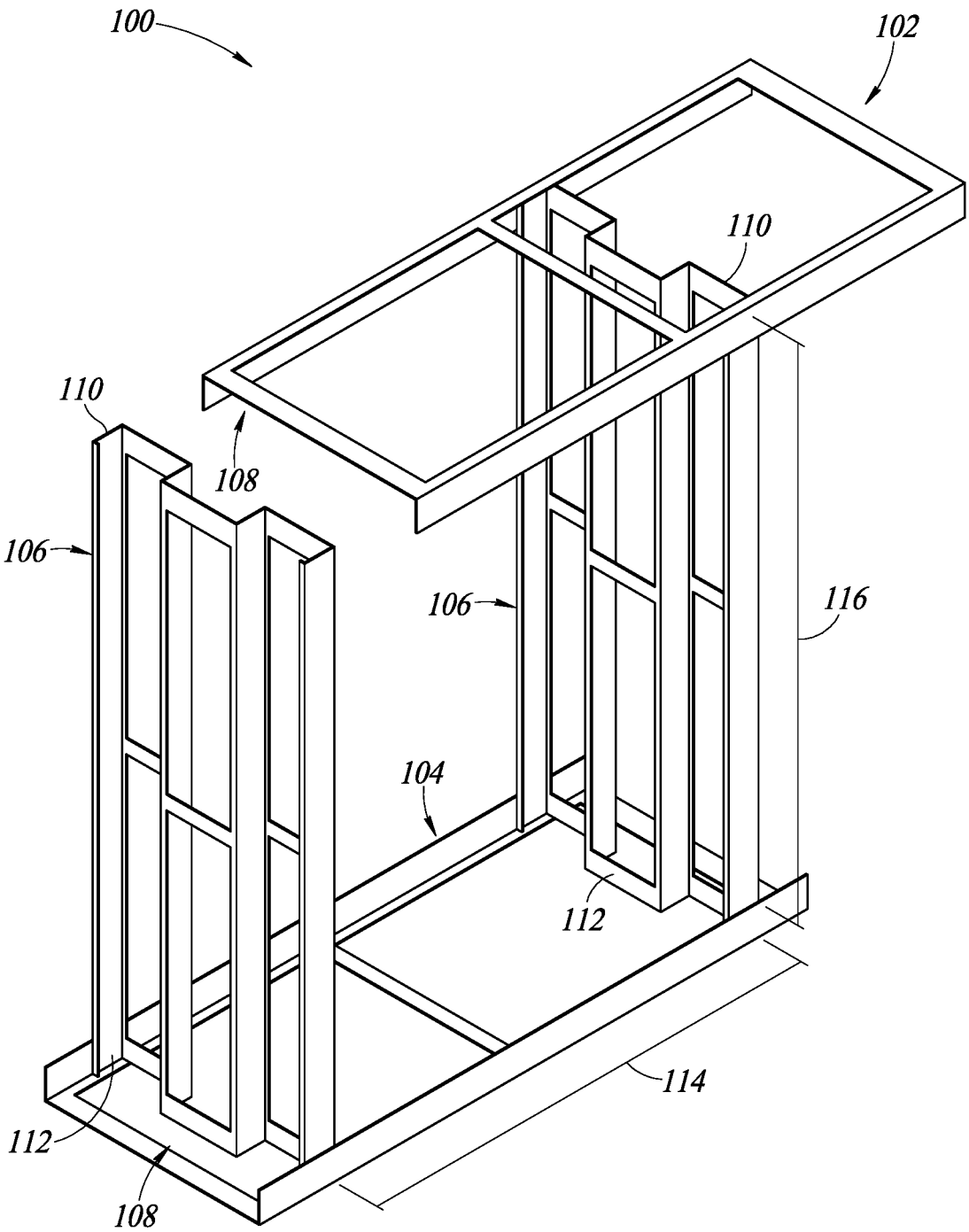
FIG. 1 is an isometric view of an embodiment of a wall assembly according to the present disclosure.

FIG. 1 is an isometric view of one or more embodiments of a wall assembly 100 shown without drywall or gypsum board to avoid obscuring the embodiments of the present disclosure. The wall assembly 100 generally includes a first track 102, a second track 104, and wall studs 106 coupled to the first and second tracks 102, 104. The first and second tracks 102, 104 are configured to be coupled to a support such as the floor, ceiling, joists, beams, or other support structures in a conventional manner. As shown in FIG. 1, the first track 102 is aligned with the second track 104 in a horizontal direction to define an upper and lower vertical boundary of a wall, respectively. Each of the tracks 102, 104 includes a channel 108 extending along a complete length of the respective track 102, 104, as described in further detail below.

Further, each of the studs 106 includes a first end 110 and a second end 112 opposite the first end 110. The first end 110 of each stud 106 is received in the channel 108 of the first track 102 and the second end 112 of each stud 106 is received in the channel 108 of the second track 104. While the studs 106 are arranged perpendicular to the tracks 102, 104 and generally vertical in most applications, the studs 106 can also be at an angle to the tracks 102, 104, in some embodiments. The studs 106 can be sheet metal studs comprising steel, aluminum, or other like metals as well any available alloy. The studs 106 may also be any material currently listed or included in the future in the American Society for Testing Materials standards, publications, or technical papers in some embodiments. The wall studs 106 are of a unitary stud design with multiple channels to increase the wall thickness, which improves the attenuation of sound without a second row of studs. Namely, there are two or more studs joined together in a single structure stud 106 to form a unitary stud. The studs 106 are spaced from each other along the tracks 102, 104 by a distance 114 between centers of the thicknesses of the studs (or "on center") that is selected by the installer according to the construction plans. In some embodiments, the studs 106 are spaced 12 inches, 16 inches, 18 inches, or 24 inches apart, or more or less, depending on the plans.

Although FIG. 1 illustrates only two studs 106 received in the tracks 102,104 for simplicity, a typical wall may include many more studs, such as 5, 10, 15, 20, 25 or more studs, depending on the length of the wall of the spacing between the studs 106. Further, the tracks 102, 104 may have a standard length, such as 8 feet, 10 feet, or 12 feet, but multiple tracks 102, 104 can be connected in series with ends of the tracks 102, 104 abutting each other in order to reach the desired length of the tracks 102, 104. The studs 106 may similarly have a height or length 116 that is 8 feet, 10 feet, 12 feet, or any other selected dimension. The tracks 102, 104 and studs 106 can be cut in place at the installation site, if needed, to meet actual installation dimension requirements. As such, the actual installed dimensions of the tracks 102, 104 and studs 106 may vary from the whole number integers above due to errors in installation or initial calculations. Further, the studs 106 are coupled to the first and second tracks 102, 104 by any acceptable method, including fasteners such as sheet metal screws or bolts as well as by welding or soldering. The first and second tracks 102, 104 and the studs 106 may include pre-fabricated holes for receiving the fasteners. Alternatively, the tracks 102, 104 and the studs 106 may not include holes, but rather, the fasteners are inserted directly through the tracks 102, 104 and the studs 106 at locations selected by the installer.

Figure 2:
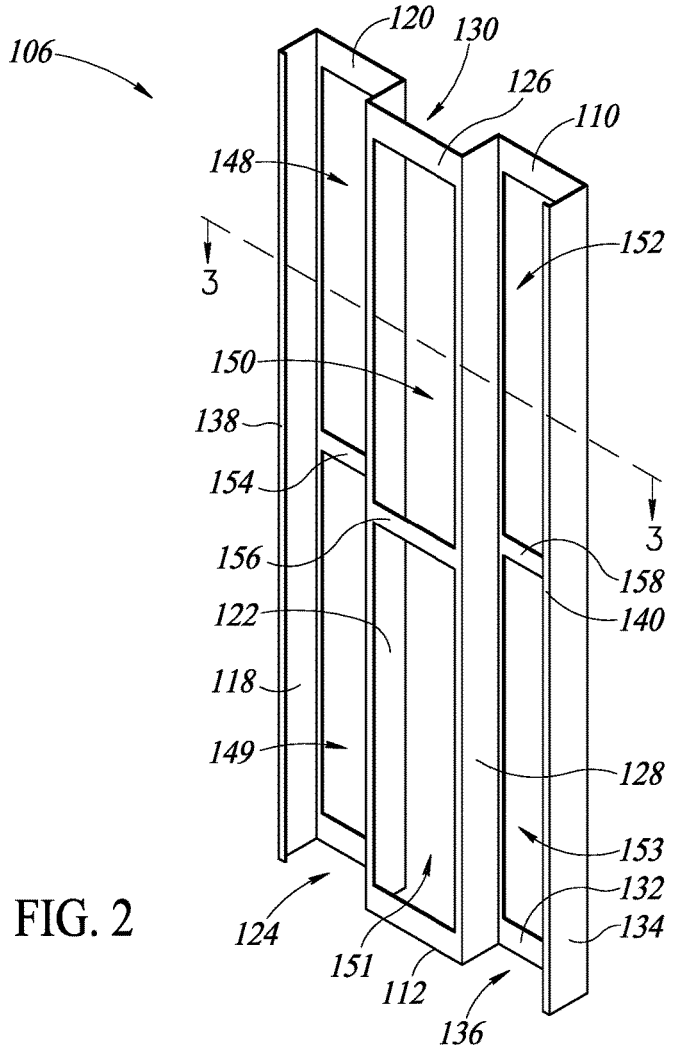
FIG. 2 is an isometric view of a unitary wall stud of the assembly of FIG. 1.
Figure 3:
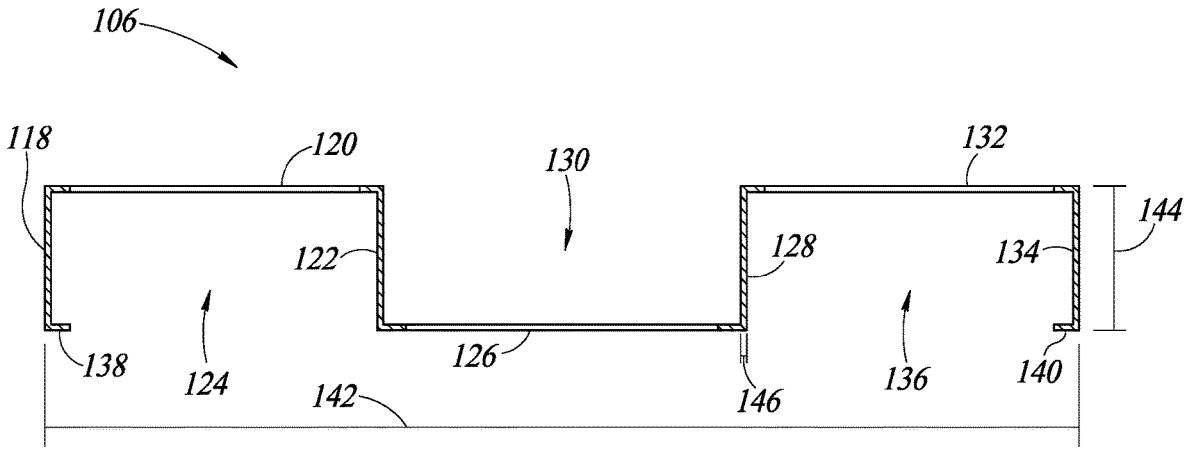
FIG. 3 is a cross-sectional view of the unitary wall stud of FIG. 2 along line 3-3 in FIG. 2.

FIG. 2 illustrates one of the unitary studs 106 separated from the tracks 102, 104 to provide more detail of the studs 106. Although the discussion will proceed below with reference to only one of the studs 106, it is to be appreciated that the concepts below can be applied equally to any of the wall studs discussed herein. FIG. 3 is a cross-sectional view of the stud 106 along line 3-3 in FIG. 2. With reference to FIG. 2 and FIG. 3, and with continuing reference to FIG. 1, the stud 106 includes the first end 110, which may be a top end, and the second end 112, which may be a bottom end. The stud 106 further includes a first sidewall 118 coupled to a first web 120 and being perpendicular to the first web 120. A second sidewall 122 is coupled to the first web 120 and is perpendicular to the first web 120. The second sidewall 122 is aligned with and parallel to the first sidewall 118, in some embodiments. Further, the second sidewall 122 is spaced from the first sidewall 118 across the first web 120 to define a first channel 124. In other words, the first channel is defined by first and second sidewalls 118, 122 and first web 120 and includes an opening that faces left in the orientation shown in FIG. 2, or down in the orientation shown in FIG. 3.

A second web 126 is coupled to the second sidewall 122 and is perpendicular to the second sidewall 122 and parallel to, but offset from, the first web 120, as shown in FIG. 3. A third sidewall 128 is coupled to the second web 126 and perpendicular to the second web 126 to define a second channel 130. The second channel 130 has an opening that faces right in the orientation shown in FIG. 2, or up in the orientation shown in FIG. 3, such that the opening of the second channel 130 is opposite that of the first channel 124, which helps isolate the channels 124, 130 and walls that defines the channels 124, 130 from each other to improve sound attenuation. As such, the second channel 130 is defined by the second sidewall 122, the second web 126, and the third sidewall 128, such that the first channel 124 and the second channel 130 share the second sidewall 122. Put a different way, the second sidewall 122 defines a boundary, or is a sidewall, of both the first channel 124 and the second channel 126 of each stud 106, in some embodiments. The third sidewall 128 is also parallel to, and aligned with, the first and second sidewalls 118, 122. A third web 132 is coupled to the third sidewall 128 and is perpendicular to the third sidewall 128. The third web 132 is aligned with the first web 120 and offset from the second web 126 by the second and third sidewalls 122, 128.

A fourth sidewall 134 is coupled to the third web 132 and is perpendicular to the third web 132 to define a third channel 136. The third channel 136 has an opening that faces in the same direction as the first channel 124 and opposite to the second channel 130. In some embodiments, each of the channels 124, 130, 136 face the same direction, or two successive channels, such as the first and second channels 124, 130 face the same direction, while the third channel 136 faces an opposite direction. In some embodiments, the stud 106 includes only two of the channels 124, 130, 136, such as first and second channels 124, 130 or second and third channels 130, 136 to reduce the thickness of the wall containing the stud 106, while still providing sound attenuation through isolation of the structural components.

The fourth sidewall 134 is parallel to the first, second, and third sidewalls 118, 122, 128 and is spaced from the third sidewall 128 across the third web 132. The third channel 136 is defined by the third sidewall 128, the third web 132, and the fourth sidewall 134, such that the second channel 130 and the third channel 136 share the third sidewall 128. Put differently, the third sidewall 128 forms a boundary of both the second channel 130 and the third channel 136. The second web 126 being offset from the first and third webs 120, 132 creates isolation between the walls defining each channel 124, 130, 136, such that the structure of the stud 106 attenuates sound. Each of the first and third channels 124, 136 and the corresponding walls that define the channels 124, 136 may be considered a separate stud with the studs joined together by the second web 126 to form the unitary stud assembly 106. Further, including shared walls or sidewalls between the channels 124, 130, 136 reduces the overall thickness of the stud 106 while also eliminating the labor hours and costs associated with installing multiple single studs together. In some embodiments, the stud 106 further includes a flange 138 coupled to a terminal end of the first sidewall 118 and extending into the first channel 124 and a flange 140 coupled to a terminal end of the fourth sidewall 134 and extending into the third channel 136.

The dimensions of each component part of the stud 106 can be selected according to design preference or load bearing capacity for certain applications. For example, the stud 106 has a width 142 from an outer surface of the first sidewall 118 to an outer surface of the fourth sidewall 134 that could be any dimension between 1 inch and 24 inches, or more or less. In some embodiments, the width 142 is the size of two standard wall studs, or approximately 7.25 inches. The stud 106 further has a depth 144 between an outer surface of the flange 140 and an outer surface of the third web 132 that is between 0.25 inches and 6 inches, or more or less. In some embodiments, the depth 144 is 1.25 inches or 2 inches. Further, the walls have a thickness 146 or gauge that can be selected. In some embodiments, the thickness 146 is less than 3 mm or less than ⅛ inch. In one or more embodiments, the thickness 146 is any value between 10 mils (0.010 inch) to 100 mils (0.10 inch), or more or less. The dimensions 142, 144, 146 of the stud 106 are selected according to span length, load bearing requirements, as well as desired wall thickness and sound attenuation properties.

In some embodiments, the depth 144 is the same for each of the channels 124, 130, 136, while in one or more embodiments, the depth 144 is different for each channel, such as the first and third channels 124, 136 having a greater or less depth than the second channel 130, or each of the channels having different depths. Further, each of the channels 124, 130, 136 have the same width in one or more embodiments, but can also have different widths in some embodiments. In one non-limiting example, the second channel 130 may have a width greater or less than the first and third channels 124, 136.

The stud 106 further includes a first opening 148 (see FIG. 2) through the first web 120, a second opening 150 through the second web 126, and a third opening 152 through the third web 132. The openings 148, 150, 152 further attenuate sound waves by isolating the sidewalls 118, 122, 128, 134 from the webs 120, 126, 132. Further, the openings 148, 150, 152 prevent resonance of sound through the stud 106. A size and shape of the openings 148, 150, 152 can be selected according to several factors, including but not limited to, design preference, amount of desired sound attenuation, and load bearing capacity. As such, although the openings 148, 150, 152 are illustrated as being rectangular, the openings 148, 150, 152 could be any other shape. As shown in FIG. 2, some embodiments of the present disclosure include a stud with a first divider 154 coupled to the first web 120 and extending across the first opening 148 to divide the first opening 148 into two openings 148, 149 that are spaced vertically along the first web 120.

Similarly, a second divider 156 is coupled to the second web 126 and extends across the second opening 150 to divide the second opening 150 into two openings 150, 151 that are spaced vertically along the second web 126. A third divider 158 is coupled to the third web 132 and extends across the third opening 152 to divide the third opening 152 into two openings 152, 153 that are spaced vertically along the third web 132. Although the dividers 154, 156, 158 are illustrated in FIG. 2 as being located centrally relative to a height or length of the stud 106 and each of the webs 120, 126, 132, in some embodiments, the dividers 154, 156, 158 are offset from each other, such that the openings 148, 149, 150, 151, 152, 153 have different sizes. Further, the openings 148, 149, 150, 151, 152, 153 may have a different size than that shown, such as being narrower and shorter, or wider and longer, or any combination thereof, relative to the illustrated embodiment. Further, the dividers 154, 156, 158 may be wider or thinner than those illustrated in FIG. 2, in some embodiments.

The stud 106 is designed to have sufficient structural strength despite the openings 148, 149, 150, 151, 152, 152, 153 because the sidewalls 118, 122, 128, 134 do not include openings in order to provide load bearing support, while the dividers 154, 156, 158 improve the rigidity and stiffness of the stud 106 to resist shearing and torsional loads. Further, as mentioned above, the studs 106 can be selected to have dimensions that allow for sufficient load bearing capacity for use in structural applications even with openings 148, 149, 150, 151, 152, 153. For example, increasing the thickness 146 will provide greater support to account for the loss of the material in the webs 120, 126, 132 due to the openings 148, 149, 150, 151, 152, 153. In addition, the openings 148, 149, 150, 151, 152, 153 may be formed by various post-processing techniques, such as stamping the stud 106 to create the openings 148, 149, 150, 151, 152, 153 and the dividers 154, 156, 158 after the stud 106 is rolled into the illustrated shape. However, it may also be possible to form the studs 106 into the shape shown through various molding or casting techniques.

Further, while steel is generally considered a good conductor of sound, the thickness 146 can be reduced, while increasing other measurements to attain load bearing strength, to further dampen sound. Because of the design of the stud 106, each of the channels 124, 130, 136 are isolated from each other, such that the walls defining each channel 124, 130, 136 are spaced from each and are formed of relatively thin steel. As such, an acoustic wave in one channel 124, 130, 136 will not travel well through the thin metal sheet and the acoustic wave will therefore be effectively attenuated. The openings 148, 149, 150, 151, 152, 153 in the stud 106 further disrupt propagation of acoustic waves and prevent resonance of the acoustic wave through the stud 106 to further attenuate the acoustic waves.

Figure 4:
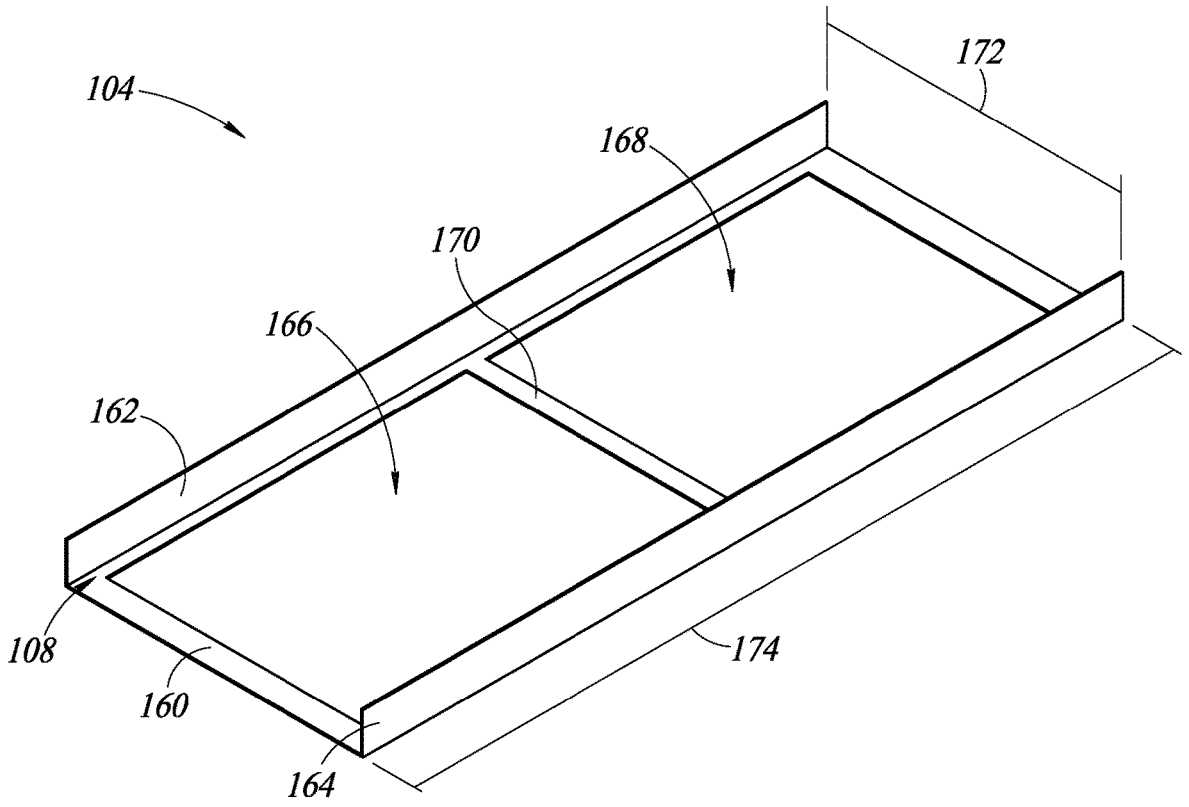
FIG. 4 is an isometric view of a track of the assembly of FIG. 1.

FIG. 4 illustrates an isometric view of the second track 104 separate from the assembly 100 to provide more detail of the track 104. The features of the second track 104 are the same as the first track 102, in some embodiments, although the installation orientation of the first track 102 may be the opposite of the second track 104, as shown in FIG. 1, such that the first and second tracks 102, 104 face each other.

The second track 104 may be a bottom track and includes a web 160 and a first sidewall 162 coupled to the web 160 and arranged perpendicular to the web 160. A second sidewall 164 is coupled to the web and arranged perpendicular to the web 160 and parallel to the first sidewall 162 to define the channel 108. As shown in FIG. 4, the sidewalls 162, 164 extend in the same direction relative to the web 160, in some embodiments, although the same is not necessarily required. The track 104 further includes a first opening 166 and a second opening 168, both of which extend through the web 160. Similar to the stud 106, the openings 166, 168 in the web 160 of the track 104 may be formed by stamping or cutting after the track 104 is formed to net shape through any available method. A divider 170 is coupled to the web 160 and extends across the web 160 between the openings 166, 168. Similar to the stud 106 described above, the size, shape, and arrangement of the openings 166, 168 and the divider 170 can be selected according to a number of factors. In some embodiments, the track 104 does not include openings 166, 168, but rather, is a conventional track with the width 172 to accommodate the design of the studs 106 disclosed herein.

The channel 108 has a width 172 between a surface of the first sidewall 162 facing the channel 108 and a surface of the second sidewall 165 facing the channel 108 that is structured to receive the studs 106. As such, the width 172 is equal to or greater than the width 142 of the stud 106 described in FIG. 3. In some embodiments, the width 172 of the track 104 allows the stud 106 to be received in the channel 108 in a clearance or friction fit. Further, the track 104 has a length 174 that may be selected to be any dimension according to design factors. However, the length 174 may be 8 feet, 10 feet, or 12 feet, in some common applications. In some embodiment, the track 104 does not include any flanges extending from the sidewalls 162, 164 into the channel 108, but rather, includes the sidewalls 162, 164 arranged vertically to allow the studs 106 to be more easily received in the channel 108.

FIGS. 5A-5K are isometric views of embodiments of a stud design that is formed as a unitary, two stud structure according to the present disclosure. Except as otherwise specified below, each of the studs described with reference to FIGS. 5A-5K may be similar to stud 106 described above. As such, repetitive description has been omitted for efficiency and to avoid obscuring the embodiments.

Figure 5A:
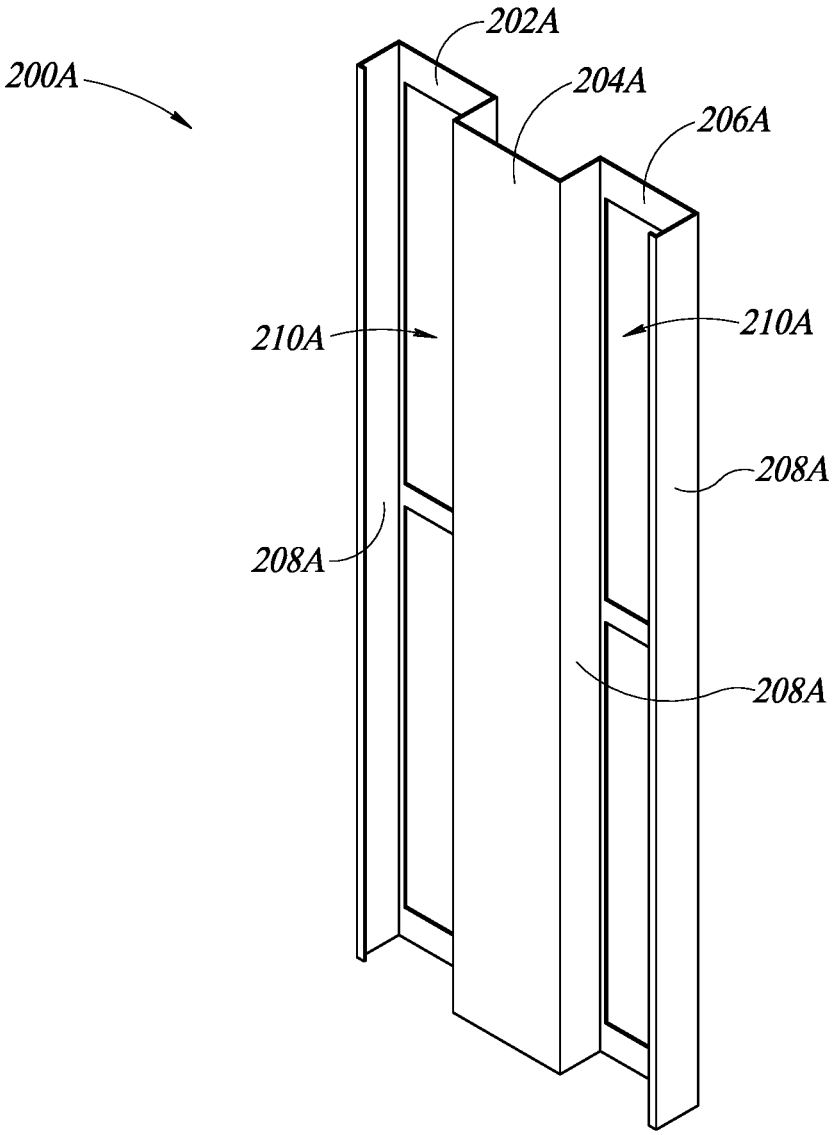
FIGS. 5A-5K are isometric views of various embodiments of a unitary wall stud according to the present disclosure.

Beginning with FIG. 5A, a wall stud 200A has a first web 202A, a second web 204A, and a third web 206A coupled to each other by walls 208A. In some embodiments, the second web 204A, which may be a central web joining the two studs together in unitary assembly, does not include any openings. Rather, the second web 204A is a solid, continuous piece of sheet metal to further improve the structural integrity of the stud 200A. Each of the first and third webs 202A, 206A include openings 210A, which are similar to those described herein with reference to stud 106. As such, only two of the webs 202A, 204A, 206A include openings 210A, in some embodiments. In one non-limiting example, only the first and second web 202A, 204A include openings 210A, while in another non-limiting example, only the second and third webs 204A, 206A include openings 210A. As such, the number of webs 202A, 204A, 206A that include openings 210A and the configuration of the openings 210A can be selected according to design factors.

Figure 5B:
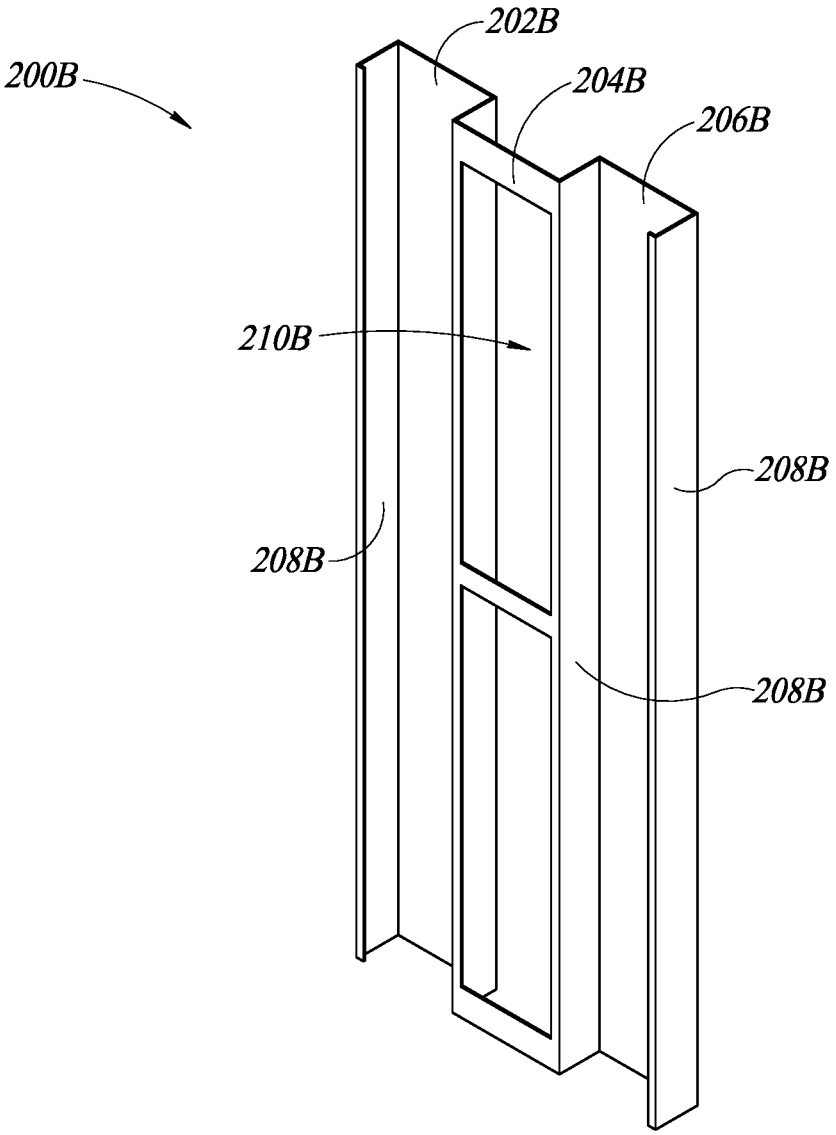

FIG. 5B illustrates a wall stud 200B with an opposite arrangement to that of the stud 200A in FIG. 5A. More specifically, the stud 200B includes a first web 202B, a second web 204B, and a third web 206B coupled to each other by walls 208B. FIG. 5B illustrates that in some embodiments, only one of the webs 202B, 204B, 206B include openings 210B. In the illustrated embodiment, only the central second web 204B includes openings 210B. However, in some embodiments, only the first web 202A or only the third web 206B includes openings 210B. The webs 202B, 204B, 206B that do not include openings 210B are solid, continuous pieces of material in order to improve the load bearing capacity of the stud 200B, while the design of the stud 200B and the openings 210B provide for attenuation of acoustic waves.

Figure 5C:
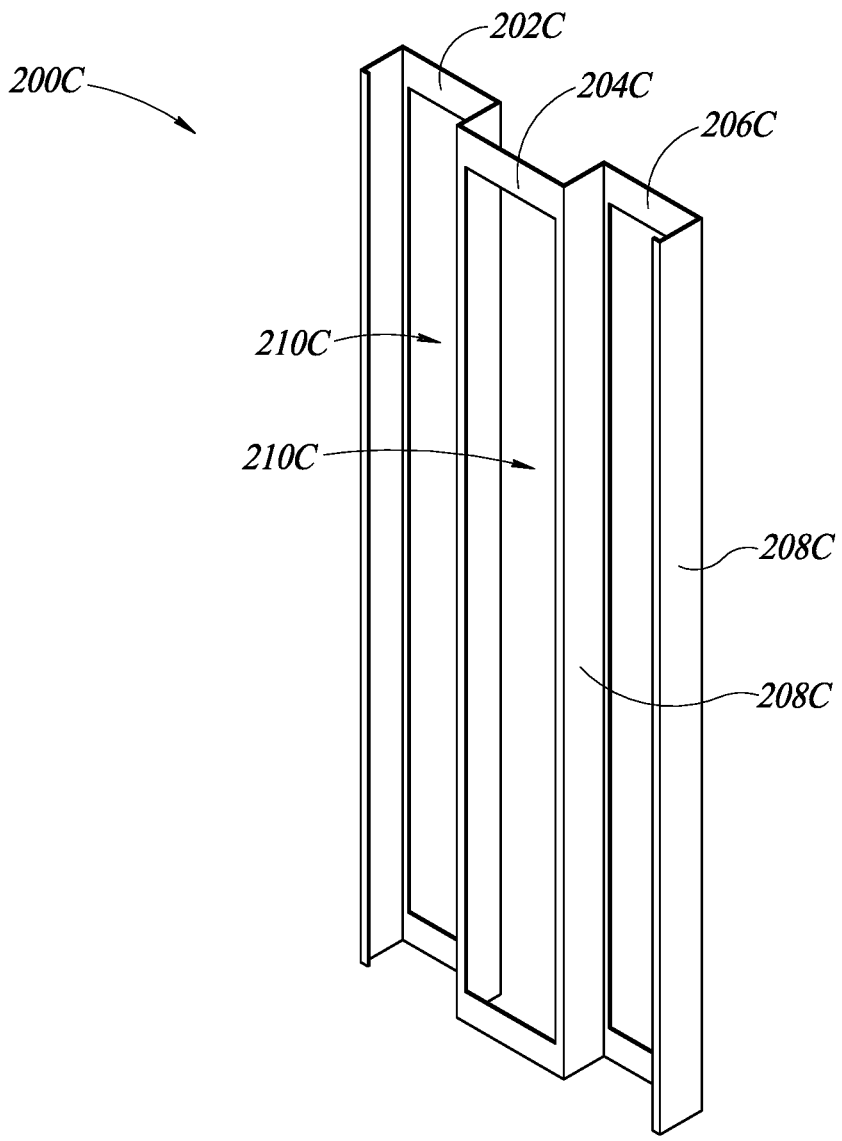

FIG. 5C illustrates a further non-limiting example of a stud 200C where there is only one opening through each web. More specifically, the stud 200C includes a first web 202C, a second web 204C, and a third web 206C coupled to each by walls 208C. Each of the webs 202C, 204C, 206C include an opening 210C through the respective web 202C, 204C, 206C. However, the opening 210C is a single opening, meaning that it is not separated into smaller openings by a portion of the web 202C, 204C, 206C or the dividers described herein. In some embodiments, all of the webs 202C, 204C, 206C have a single opening 210C, which can be of any size or shape, while in one or more embodiments, only one or only two of any of the webs 202C, 204C, 206C includes a single opening 210C with the remaining webs 202C, 204C, 206C having no openings or a different arrangement of openings.

Figure 5D:
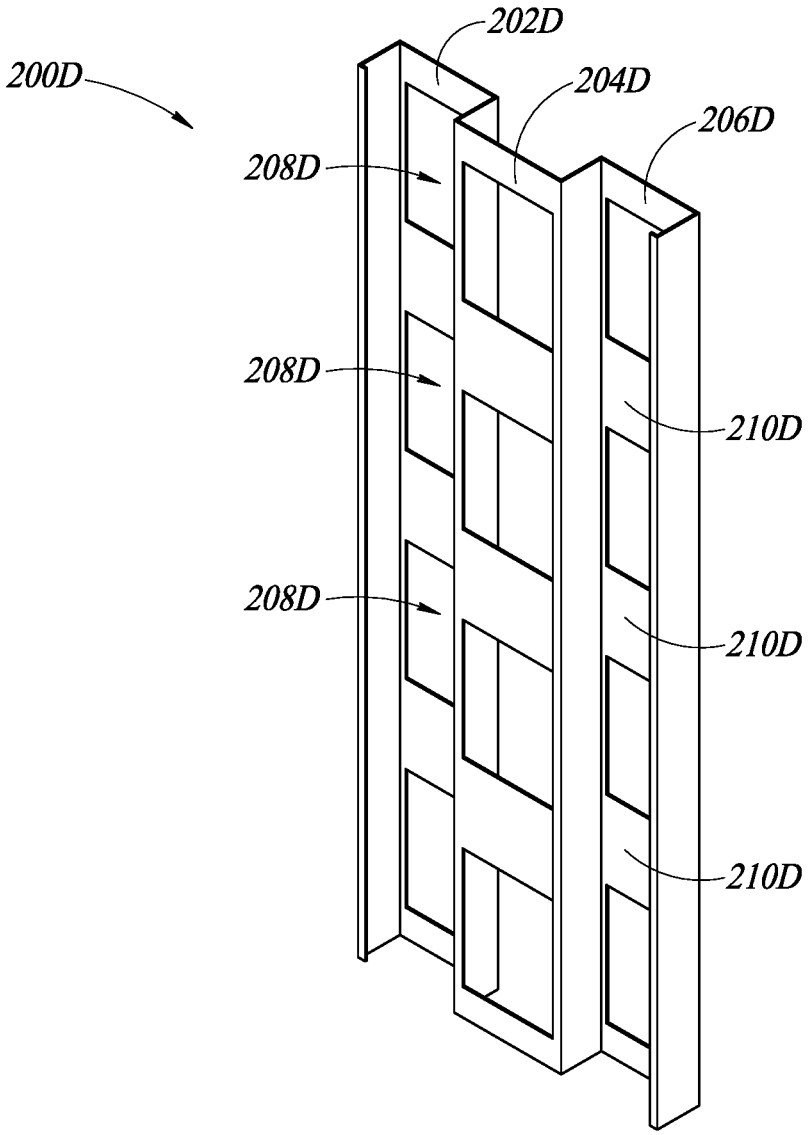

FIG. 5D illustrates one or more embodiments of a stud 200D with three webs 202D, 204D, 206D and four openings 208D per web 202D, 204D, 206D. The openings 208D are separated by three dividers 210D per web 202D, 204D, 206D. As such, the present disclosure is not limited to studs with only one or two openings per web, but rather, each web can include any selected number of openings 208D and a corresponding dividers 210D, such as three, four, five, six, seven, eight, nine, ten, or more openings 208D and a corresponding number of dividers 210D.

Figure 5E:
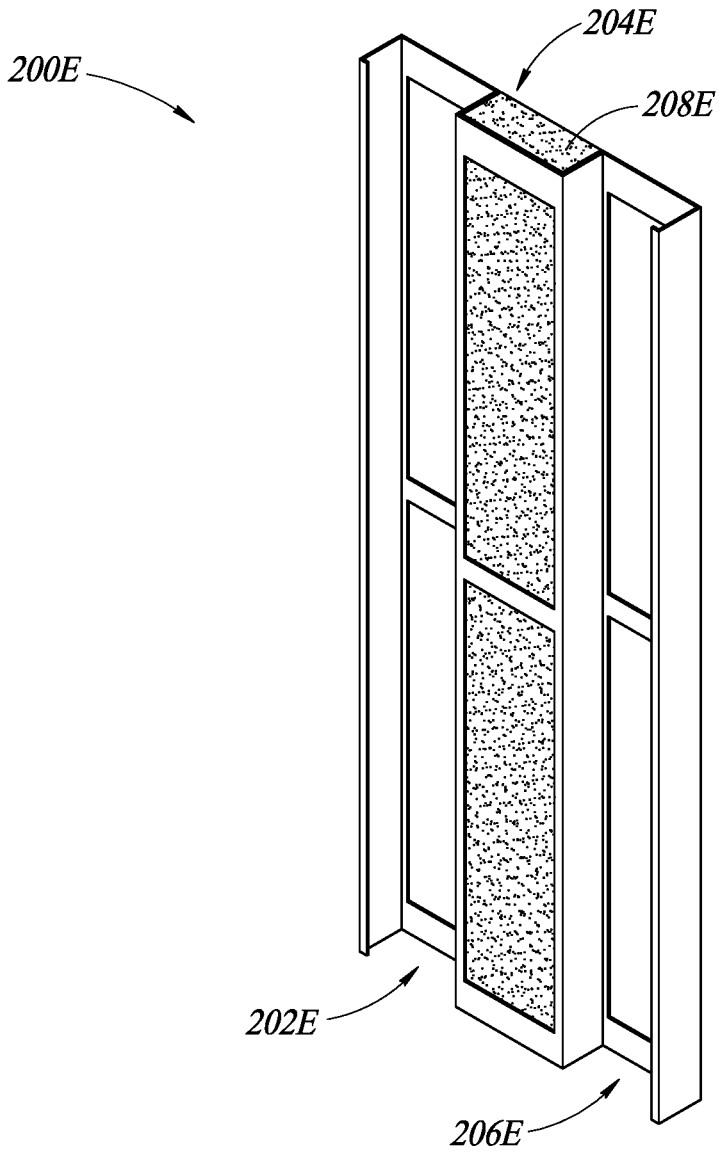
Figure 5F:
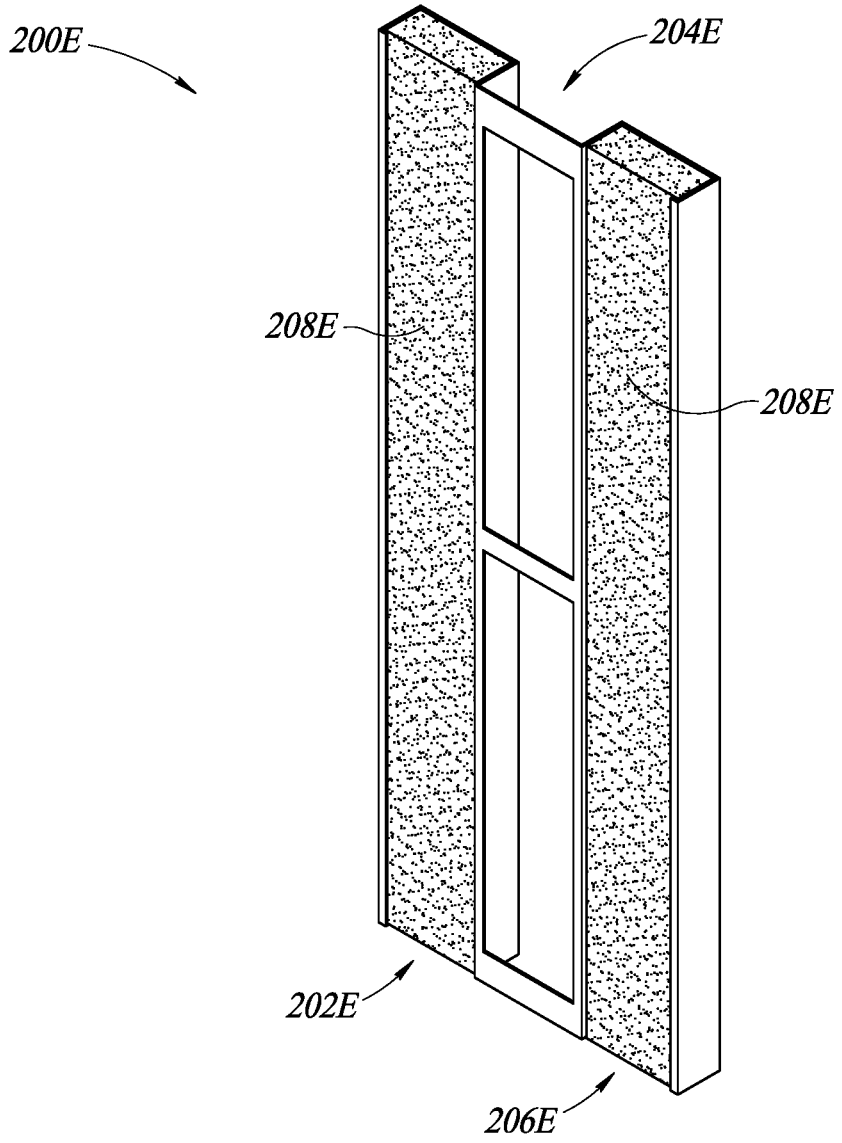
Figure 5G:
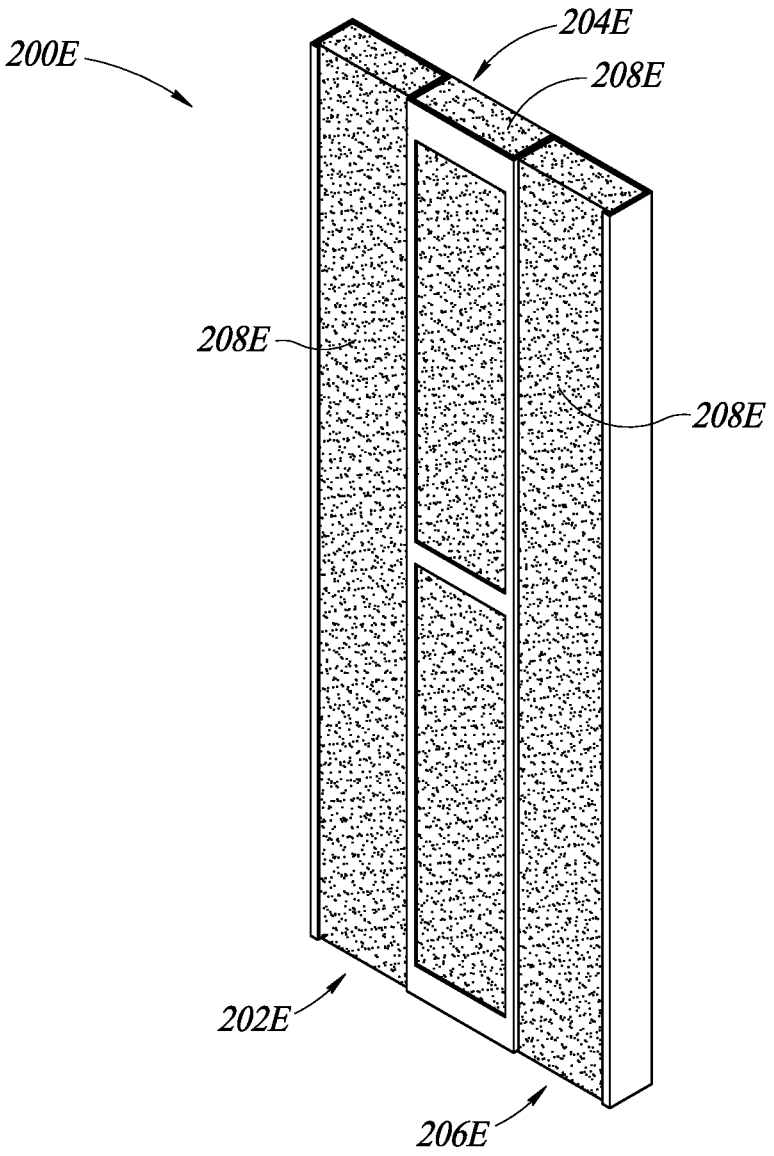

FIGS. 5E-5G illustrate a stud 200E that includes a block of material received in one or more channels of the stud 200E to further improve attenuation of acoustic waves. In FIG. 5E, a stud 200E includes a first channel 202E, a second channel 204E, and a third channel 206E. A generally rectangular block of material 208E is received only in the second or middle channel 204E. In some embodiments, the material 208E extends an entire length of the second channel 204E, while in one or more embodiments, the material 208E has a length that is less than a length of the second channel 204E. Further, the material 208E may have a width and depth that is selected to be received in the second channel 204E. The material 208E may be received in the second channel 204E in a friction or clearance fit, such that it is not necessary to couple the material 208E to the stud 200E. However, in some embodiments, the material 208E is coupled to the stud 200E by any acceptable method, such as with an adhesive material such as glue, tape, a fastener, or any other acceptable technique.

In some embodiments, the material 208E is made of any acceptable material that has low acoustic transmission and sufficient structural strength in order to adhere to the stud 200E. There are a number of types of material which would be acceptable for the material 208E. In some non-limiting examples, the material 208E may include various types of rigid materials, rubber, plastic, PVC, foam, sponges, gels, or the like. In a further non-limiting example, the material 208E may be IV3, which is a foam cell polymer material. In the industry, it is sometimes sold under the name Ensolite IV3 and is available from many different manufacturers. This is a closed-cell stiff foam material that is made of a polymer. Further, the material 208E can, in some instances, include neoprene, PVC, or a type of sponge rubber, among other available materials. In some embodiments, the material 208E is added or coupled to the stud 200E at a mass production factory and the completed assembly is sent to a construction site in standard lengths, such as 8 feet, 10 feet, or 12 feet. The installer can then install the stud 200E, with material 208E in a single installation step to reduce costs and installation time, with the material 208E providing further attenuation of acoustic waves relative to other studs described herein.

In FIG. 5F, the stud 200E includes the material 208E in both the first and third channels 202E, 206E, but not in the second channel 204E. In some embodiments, the material 208E is in any two of the channels 202E, 204E, 206E and only two of the channels 202E, 204E, 206E. Further, FIG. 5F illustrates that the material 208E can fill the entirety of each channel 202E, 204E, 206E in some embodiments. The material 208E may be a single, continuous, homogeneous block of material, as illustrated, or may be separated into individual and distinct parts and received in the channels 202E, 204E, 206E in a spaced arrangement. For example, in some embodiments, the material 208E is separated into three pieces that are received in the first channel 202E and spaced from each along the first channel 202E to provide further isolation between the structural components of the stud 200E. FIG. 5G illustrates that the stud 200E can also include the material 208E in all of the channels 202E, 204E, 206E in one or more embodiments.

Figure 5H:
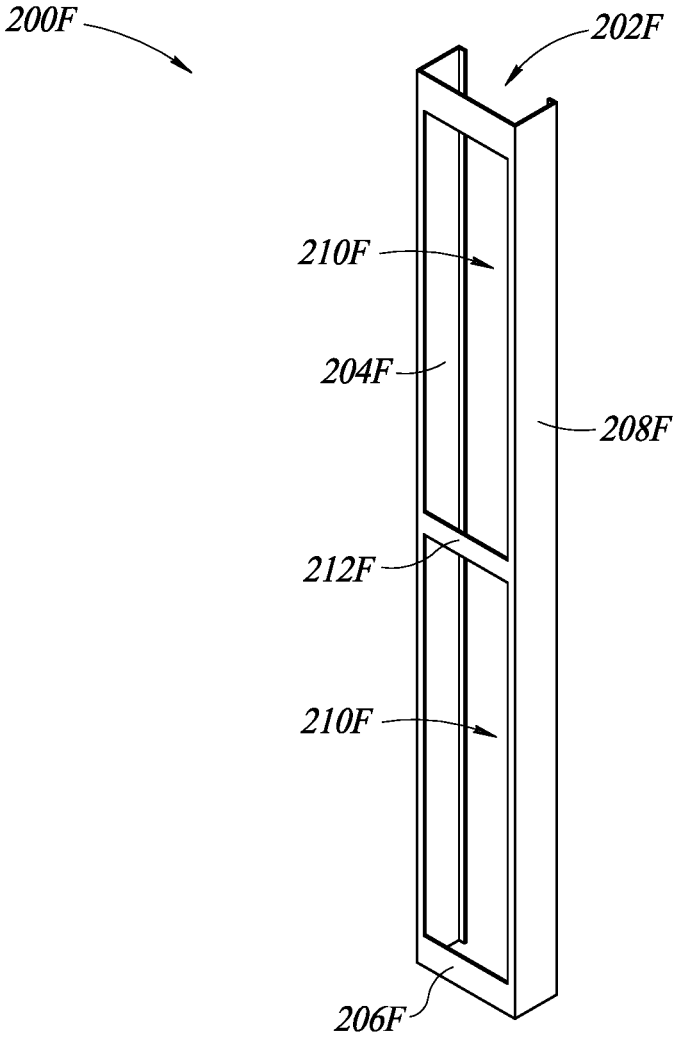

FIG. 5H illustrates a stud 200F with only a single channel 202F. More specifically, FIG. 5H applies the principles of the present disclosure to a typical metal stud to improve the sound attenuation characteristics of a standard metal stud. The stud 200F includes a first sidewall 204F coupled to a web 206F and a second sidewall 208F coupled to the web 206F and spaced from the first sidewall 204F across the web 206F to define the channel 202F. The stud 200F further includes two openings 210F through the web 206F that are separated by a divider 212F. The openings 210F can also be arranged according to any of the other embodiments described herein as well as their structural equivalents.

Figure 5I:
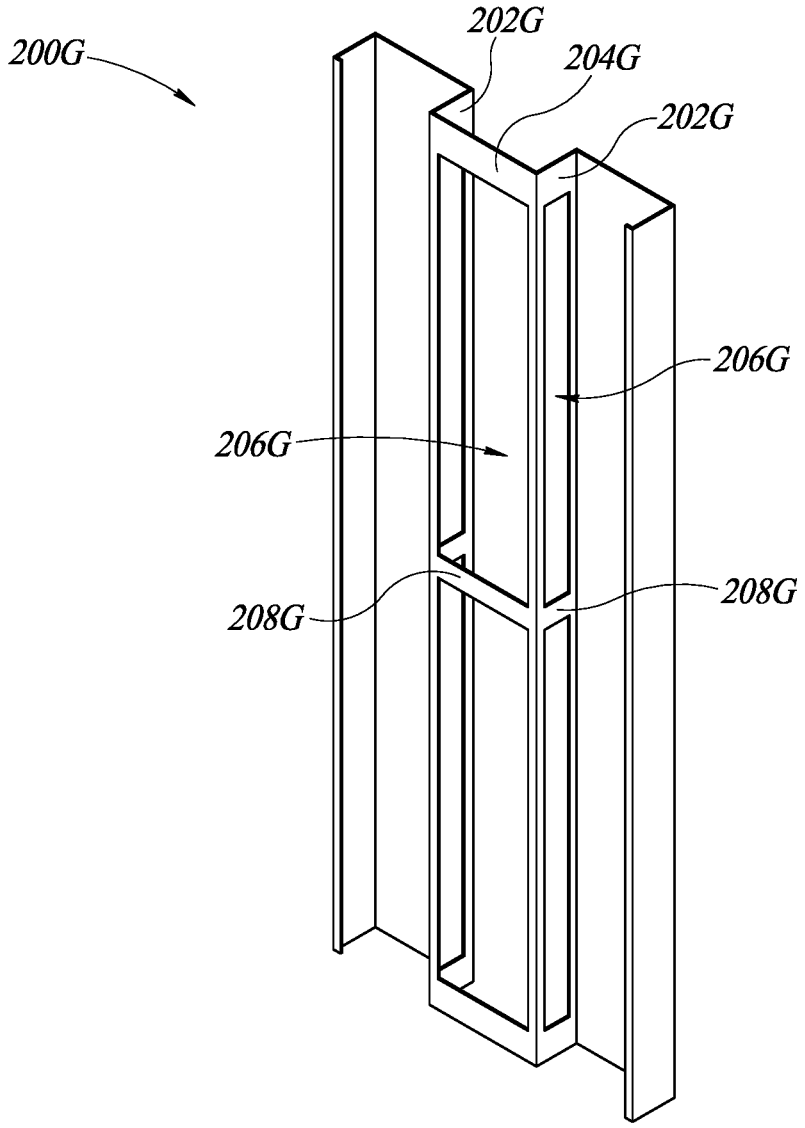

FIG. 5I illustrates a stud 200G with openings through sidewalls of the stud 200G. More specifically, the stud 200G includes sidewalls 202G coupled to a web 204G. The stud 200G includes a plurality of openings 206G through the sidewalls 202G and the web 204G that are separated by dividers 208G. In some embodiments, the stud 200G includes openings 206G only through one or more of the sidewalls 202G. In one or more embodiments, as illustrated, the stud 200G includes openings 206G through at least one web 204G and at least one sidewall 202G. Further, some, but not all of the webs 204G and sidewalls 202G may have openings in order to vary the load bearing capacity of the stud 200G. Put a different way, if it is desired to increase the load bearing capacity of the stud 200G, then the openings 206G can be only through one or more of the sidewalls 202G, such that the webs 204G provide structural support. Alternatively, a combination of openings 206G through the sidewalls 202G and webs 204G may be selected according to load bearing capacity.

Figure 5J:
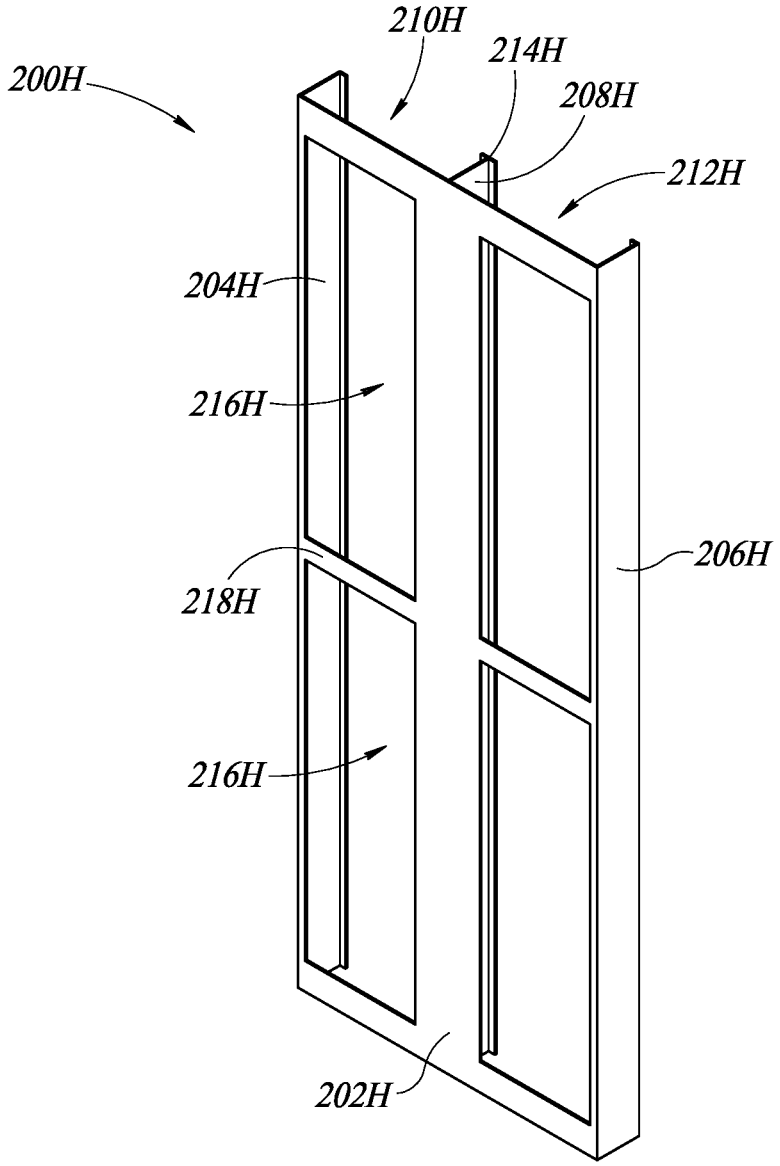

FIG. 5J illustrates a stud 200H with a different shape and configuration than the remaining studs described herein. The stud 200H includes a first web 202H with a width that may be approximately twice the width, or more or less, than the other webs described herein. A first sidewall 204H and a second sidewall 206H are coupled to the first web 202H on opposite sides of the first web 202H and positioned perpendicular relative to the first web 202H. A second web 208H is coupled to the first web 202H proximate a center of the first web 202H and in some embodiments, extends an entirety of the length of the first web 202H. The second web 208H is positioned perpendicular to the first web 202H to define a first channel 210H and a second channel 212H.

In some embodiments, the stud 200H further includes a flange 214H coupled to the second web 208H and positioned perpendicular to the second web 208H and parallel to the first web 202H. As such, the first web 202H, the second web 208H, and the flange 214H act as an I-beam in the middle of the stud 200H to increase the load bearing capacity of the stud 200H, while reducing the double channel design reduces the overall width of the stud 200H. The stud 200H further includes openings 216H through the first web 202H only in some embodiments, separated by dividers 218H, to isolate the components of the stud 200H and attenuate acoustic waves. However, as above, the openings 216H can also be through the second web 208H as well as the sidewalls 204H, 206H.

Figure 5K:
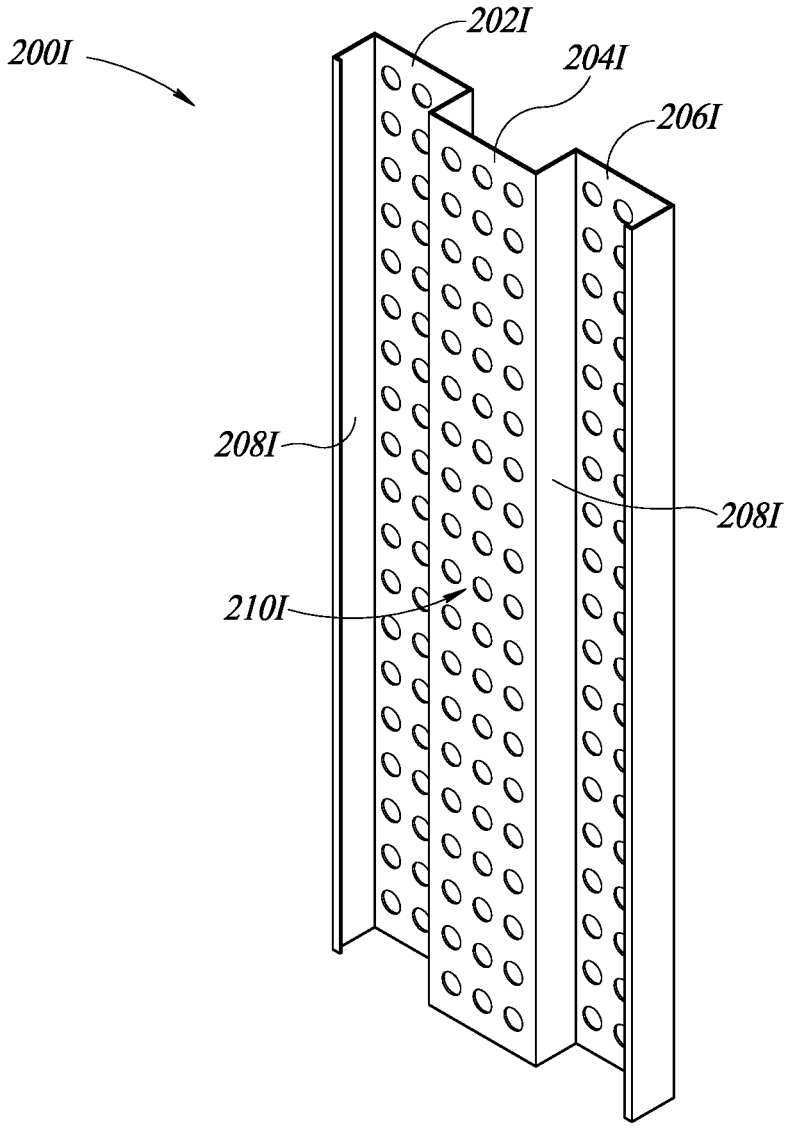

FIG. 5K illustrates a stud 200I with a large number of small openings through the stud 200I, rather than fewer, larger openings as in the above examples. More specifically, the stud 200I includes a first web 202I, a second web 204I, and a third web 206I coupled to each other by sidewalls 208I. Each of the webs 202I, 204I, 206I includes a plurality of holes 210I, which may be spaced equidistant from each other, or arranged in any other acceptable configuration. In some embodiments, each web 202I, 204I, 206I includes at least 10, at least 20, at least 30, at least 40, at least 50, at least 60, at least 70, at least 80, at least 90, or at least 100 or more holes 210I positioned in any configuration. In some embodiments, only two of the webs 202I, 204I, 206I include the holes 210I, while in one or more embodiments, only one of the webs 202I, 204I, 206I includes the holes 210I. Further, any or all of the sidewalls 208I can include the holes 210I, in some embodiments. Using smaller holes 210I may increase the load bearing capacity of the stud 200I while providing isolation that attenuates acoustic waves and present resonance of acoustic waves through the stud. The concepts of FIGS. 5A-5K can be combined with any of the studs and tracks described herein to provide further embodiments.

Figure 6:
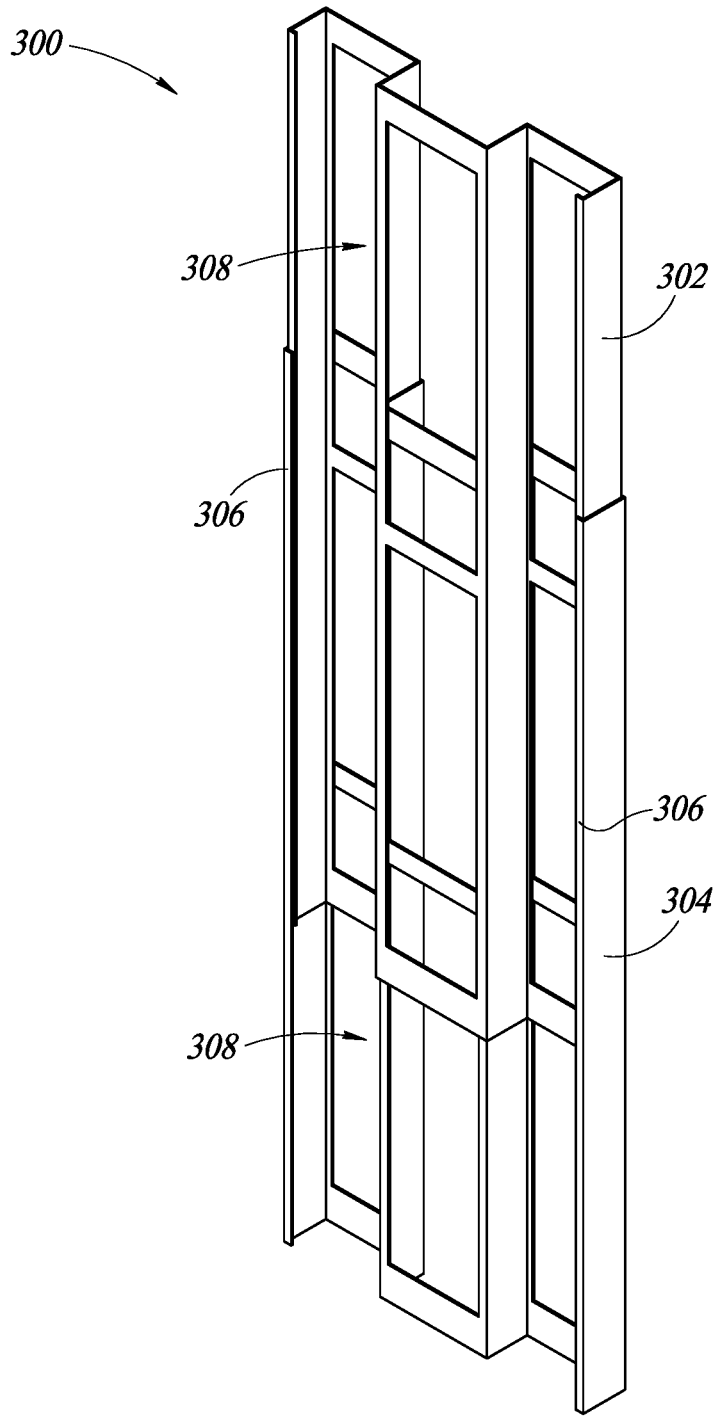
FIG. 6 is an isometric view of an embodiment of a telescoping unitary stud assembly with two stud sections according to the present disclosure.

FIG. 6 illustrates an embodiment of a stud assembly 300 that telescopes in length to account for variations in installation height without the need to cut the studs at the installation location. The stud assembly 300 includes a first stud 302 and a second stud 304, both of which may be similar to the stud 106 described above with reference to FIG. 2. However, in FIG. 6, the first stud 302 is nested with and telescopically received in the channels of the second stud 304 in a friction or clearance fit such that the first stud 302 can slide relative to the second stud 304. Similarly, the second stud 304 can slide relative to the first stud 302. Flanges 306 of the second stud 304 hold the first stud 302 in place relative to the second stud 304 in a lateral direction and fasteners may be coupled to the studs 302, 304 with fasteners to hold the first stud 302 in place relative to the second stud 304 in a longitudinal direction while also providing additional structural strength and rigidity, as described herein. Although FIG. 6 illustrates the stud assembly 300 including only first and second studs 302, 304, the assembly 300 may include more than two studs, such as three, four, five or more studs in some non-limiting examples. In use, a set of construction plans may call for 8 foot wall studs to construct a standard 8 foot interior wall. However, due to variations in installation or actual dimensions, the studs may need to be less than 8 feet, such as 7.75 feet or greater than 8 feet, such as 8.25 feet. As such, the first stud 302 slides in and out of the second stud 304 to account for these variations without the need to cut the studs 302, 304 to size, which saves time and reduces material waste due to cutting and cutting errors. The stud assembly 300 can be used in place of the studs 106 described in FIG. 1. Once the stud assembly 300 is in place and at the final length, fasteners such as sheet metal screws, or other adhesive methods can be used to mechanically couple the first and second studs 302, 304 to each other for structural integrity of the assembly 300. In some embodiments, the studs 302, 304 include pre-fabricated holes with selected spacing between the holes for receiving the fasteners, or the fasteners may be inserted directly through the studs 302, 304 at locations selected by the installer. As with stud 106, openings 308 through each stud 302, 304 attenuate acoustic waves through isolation. Only one of the studs 302, 304 may have openings 308, or both studs 302, 304 may have openings 308, in some embodiments.

Figure 7A:
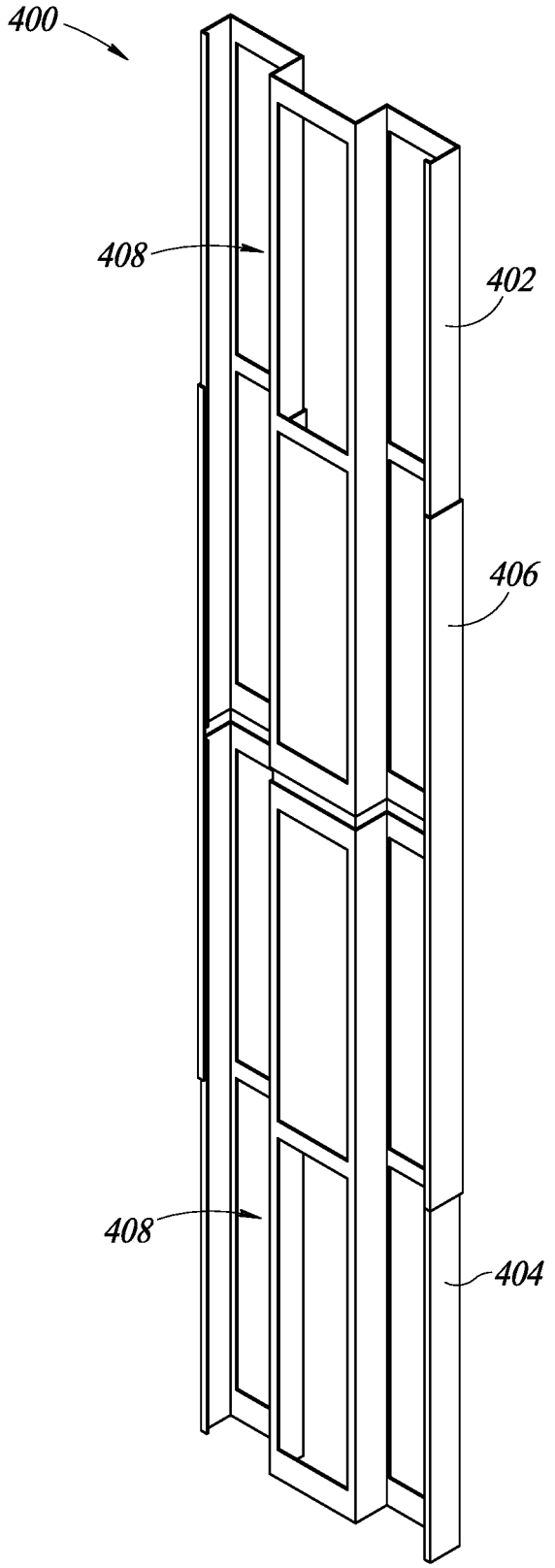
FIG. 7A is a front isometric view of an embodiment of a telescoping unitary stud assembly with three stud sections according to the present disclosure.
Figure 7B:
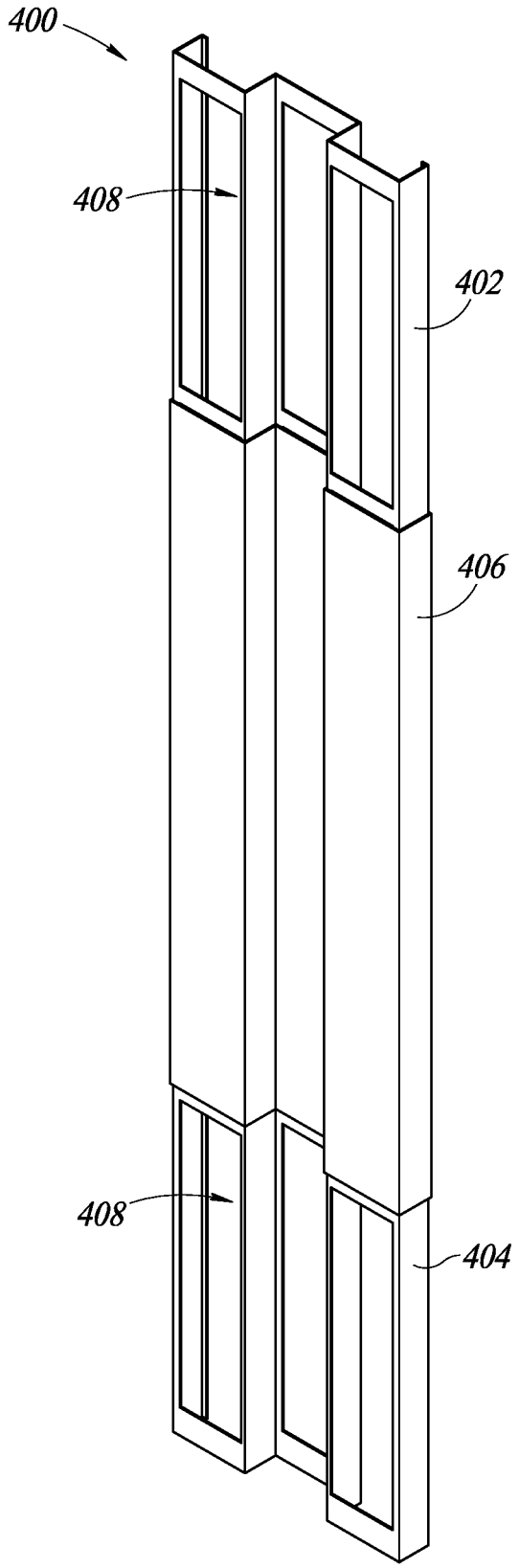
FIG. 7B is a rear isometric view of the telescoping unitary stud assembly of FIG. 7A.

FIG. 7A and FIG. 7B illustrate one or more embodiments of a stud assembly 400 that telescopes in length, but with a different arrangement and components than the assembly 300. FIG. 7A is a front isometric view of the assembly 400 and FIG. 7B is a rear isometric view of the assembly 400. With reference to FIG. 7A and FIG. 7B, the assembly 400 includes a first stud 402 and a second stud 404, which both may be similar to the stud 106 described with reference to FIG. 2, but with a shorter length. The first and second studs 402, 404 may also be referred to herein as extension studs. The assembly 400 further includes a central stud 406. The central stud 406 may have a similar shape to the stud 106 described with reference to FIG. 2, but without any openings, in some embodiments.

In some embodiments, the central stud 406 has openings that are similar to the stud 106. The first and second studs 402, 404 are telescopically received or nested in the central stud 406 and configured to slide relative to the central stud 406. Similar to the stud assembly 300, the overall length of the assembly 400 can be adjusted to account for actual installation dimensions by sliding the first and second studs 402, 404 relative to the central stud 406. Each of the first and second studs 402, 404 and the central stud 406 may have a length that is equal to half of a standard stud length, in some embodiments, such as 4 feet. As such, the assembly 400 can be adjusted from 8 feet to a maximum of 12 feet, such that the same assembly 400 can be used for various sizes of walls. As with assembly 300, the first and second studs 402, 404 can be coupled to the central stud 406 in the final installed configuration with fasteners or any other acceptable coupling method. In FIG. 7A and FIG. 7B, each of the first and second studs 402, 404 include openings 408 to attenuate acoustic waves, while the central stud 406 is solid to increase the load bearing capacity of the assembly 400. However, any or all of the studs 402, 404, 406 may have or may not have openings. The size and configuration of the openings 408 can be selected according to the factors discussed herein.

The concepts described with reference to FIGS. 6, 7A, and 7B can be applied equally to the tracks 102, 104 to provide further embodiments. For example, in an embodiment, either or both of the tracks 102, 104 similarly include a first track and a second track nested within, and telescopically received by the first track such that the tracks 102, 104 have an adjustable length. In one or more embodiments, either or both of the tracks 102, 104 include three sections similar to stud 400.

According to one embodiment, there is provided an assembly, comprising: a first stud, including a first sidewall; a first web coupled to the first sidewall; a second sidewall coupled to the first web to define a first channel; a second web coupled to the second sidewall; a third sidewall coupled to the second web to define a second channel; a third web coupled the third sidewall; and a fourth sidewall coupled to the third web to define a third channel; and a second stud received by the first stud in a telescoping arrangement, the second stud configured to slide relative to the first stud and including: a first sidewall; a first web coupled to the first sidewall; a second sidewall coupled to the first web to define a first channel; a second web coupled to the second sidewall; a third sidewall coupled to the second web to define a second channel; a third web coupled the third sidewall; and a fourth sidewall coupled to the third web to define a third channel, wherein the second channel of each of the first stud and the second stud are offset from the first channel and the third channel of each of the first stud and the second stud.

The assembly may further include: a third stud received by the first stud in a telescoping arrangement, the third stud configured to slide relative to the first stud and including: a first sidewall; a first web coupled to the first sidewall; a second sidewall coupled to the first web to define a first channel; a second web coupled to the second sidewall; a third sidewall coupled to the second web to define a second channel; a third web coupled the third sidewall; and a fourth sidewall coupled to the third web to define a third channel, wherein the second channel of the third stud is offset from the first channel and the third channel of the third stud. The assembly may further include a first opening through at least one of the first web, the second web, and the third web of the first stud; and a second opening through at least one of the first web, the second web, and the third web of the second stud.

As such, the embodiments of the present disclosure provide for wall assemblies that attenuate acoustic waves through isolation. The studs can be installed as a single unit and may include openings that reduce the amount of steel used in formation, which both reduce cost. In some embodiments, the studs have an adjustable length in order to account for variations in installation dimensions or to allow the same stud to be used for different size walls.

In the above description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with structural supports, sound damping, and vibration isolation devices, systems, and methods have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to." Further, the terms "first," "second," and similar indicators of sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" or other like phrases, such as "in one or more embodiments" or "in some embodiments" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense that is as meaning "and/or" unless the content clearly dictates otherwise.

The relative terms "approximately" and "substantially," when used to describe a value, amount, quantity, or dimension, generally refer to a value, amount, quantity, or dimension that is within plus or minus 5% of the stated value, amount, quantity, or dimension, unless the context clearly dictates otherwise. It is to be further understood that any specific dimensions of components or features provided herein are for illustrative purposes only with reference to the various embodiments described herein, and as such, it is expressly contemplated in the present disclosure to include dimensions that are more or less than the dimensions stated, unless the context clearly dictates otherwise.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system, comprising:

a first track configured to be coupled to a first support, the first track including a first channel;

a second track configured to be coupled to a second support, the second track including a second channel; and a first stud coupled to the first track and the second track, the first stud having a first end received in the first channel and a second end received in the second channel, the first stud being a unitary assembly including:

a first wall;

a first opening through the first wall;

a first divider coupled to the first wall and extending across the first opening, the first opening including a first portion on a first side of the first divider and a second portion on a second side of the first divider, at least one of the first portion and the second portion of the first opening having an area relative to the first wall that is greater than an area of the first divider relative to the first wall;

a second wall coupled to the first wall;

a third wall coupled to the second wall;

a second opening through the third wall;

a fourth wall coupled to the third wall;

a fifth wall coupled to the fourth wall; and a third opening through the fifth wall.

2. The system of claim 1 wherein the first wall is parallel to the third wall and the fifth wall, and the second opening is through a majority of the third wall.

3. The system of claim 1 wherein the second wall is parallel to the fourth wall, and the third opening is through a majority of the fifth wall.

4. The system of claim 1 wherein the first stud further includes:

a first sidewall coupled to the first wall and being perpendicular to the first wall;

a second sidewall coupled to the fifth wall and being perpendicular to the fifth wall;

a first flange coupled to the first sidewall and extending toward the second sidewall; and a second flange coupled to the second sidewall and extending toward the first sidewall.

5. The system of claim 1 wherein the first stud further includes:

a second divider coupled to the third wall and extending across the second opening; and a third divider coupled to the fifth wall and extending across the third opening.

6. The system of claim 1 wherein the first track further includes:

a web;

a first sidewall coupled to the web and being perpendicular to the web;

a second sidewall coupled to the web and being perpendicular to the web, the second sidewall spaced from the first sidewall across the web; and a fourth opening through the web.

7. The system of claim 6 wherein the first track further includes a divider coupled to the web and extending across the fourth opening.

8. An assembly, comprising:

a first track configured to be coupled to a first support; and a first stud coupled to the first track, the first stud being a unitary assembly including:

a first sidewall;

a first web coupled to the first sidewall;

a second sidewall coupled to the first web to define a first channel;

a second web coupled to the second sidewall;

a third sidewall coupled to the second web to define a second channel;

a third web coupled the third sidewall; and a fourth sidewall coupled to the third web, wherein at least one of the first web, the second web, and the third web of the first stud include an opening configured to attenuate sound or vibration, and each of the first sidewall, the second sidewall, the third sidewall, and the fourth sidewall of the first stud are absent openings and configured to provide structural integrity to the first stud.

9. The assembly of claim 8 wherein the first stud further includes:

a first flange coupled to the first sidewall and extending into the first channel; and a second flange coupled to the fourth sidewall and extending into the third channel.

10. The assembly of claim 8 further comprising:

a second track aligned with the first track and configured to be coupled to a second support, the first stud coupled to the second track with the first track, the first stud, and the second track being a unitary wall assembly.

11. The assembly of claim 10 wherein the first track further includes a first opening through the first track and the second track further includes a second opening through the second track.

12. The assembly of claim 10 further comprising:

a second stud coupled to the first track and the second track and spaced from the first stud along the first track and the second track, the second stud being a unitary stud assembly including:

a first sidewall;

a first web coupled to the first sidewall;

a second sidewall coupled to the first web to define a first channel;

a second web coupled to the second sidewall;

a third sidewall coupled to the second web to define a second channel;

a third web coupled the third sidewall; and a fourth sidewall coupled to the third web to define a third channel, wherein the second channel of the second stud is offset from the first channel and the third channel of the second stud.

13. The assembly of claim 8 wherein the opening is a first opening through the first web, the first stud further including:

a second opening through the first web and spaced from the first opening vertically along the first web; and a divider coupled to the first web and extending between the first opening and the second opening, wherein the first opening and the second opening extend through a majority of a surface area of the first web.

14. The assembly of claim 8 wherein the opening is a first opening through the second web, the first stud further including:

a second opening through the second web and spaced from the first opening vertically along the second web; and a divider coupled to the second web and extending between the first opening and the second opening, wherein the first opening and the second opening have a same size and shape that are each greater than a surface area of the divider.

15. The assembly of claim 8 further comprising:

a second stud received by the first stud in a telescoping stud assembly, the second stud structured to move relative to the first stud to change a height of the telescoping stud assembly.

16. A device, comprising:

a first sidewall;

a first web coupled to the first sidewall;

a first opening through a majority of a surface area of the first web;

a second sidewall coupled to the first web to define a first channel;

a second web coupled to the second sidewall;

a third sidewall coupled to the second web to define a second channel;

a third web coupled the third sidewall; and a fourth sidewall coupled to the third web to define a third channel, wherein the second channel is offset from the first channel and the third channel.

17. The device of claim 16 further comprising:

a second opening through a majority of a surface area of the second web; and a third opening through the third web.

18. The device of claim 17 further comprising:

a first divider coupled to the first web and extending across the first opening;

a second divider coupled to the second web and extending across the second opening; and a third divider coupled to the third web and extending across the third opening.

19. The device of claim 16 further comprising:

a second opening through a majority of at least one of the second web and the third web.

20. The device of claim 16 further comprising:

a second opening through at least one of the first sidewall, the second sidewall, and the third sidewall.

* * * * *